US009248957B2

(12) United States Patent
Mullaney et al.

(10) Patent No.: US 9,248,957 B2
(45) Date of Patent: Feb. 2, 2016

(54) HEIGHT ADJUSTABLE COLUMN FOR A SHIPPING CONTAINER BUILDING STRUCTURE

(71) Applicant: LIFTING POINT PTY LTD, Penrith, New South Wales (AU)

(72) Inventors: Nicholas Bruce Mullaney, Marulan (AU); James Richard Howell, Clarence Town (AU)

(73) Assignee: LIFTING POINT PTY LTD, Penrith, New South Wales (AU)

( * ) Notice: Subject to any disclaimer, the term of this patent is extended or adjusted under 35 U.S.C. 154(b) by 0 days.

(21) Appl. No.: 14/379,217

(22) PCT Filed: Feb. 15, 2013

(86) PCT No.: PCT/AU2013/000129

§ 371 (c)(1),
(2) Date: Aug. 15, 2014

(87) PCT Pub. No.: WO2013/120138

PCT Pub. Date: Aug. 22, 2013

(65) Prior Publication Data

US 2015/0028025 A1 Jan. 29, 2015

(30) Foreign Application Priority Data

Feb. 17, 2012 (AU) ..... 2012900570

(51) Int. Cl.
*B65D 88/00* (2006.01)
*B28B 13/00* (2006.01)
(Continued)

(52) U.S. Cl.
CPC ..... *B65D 88/005* (2013.01); *B28B 13/00* (2013.01); *B65D 88/12* (2013.01);
(Continued)

(58) Field of Classification Search
CPC ..... B65D 90/0026; B65D 90/0033; B65D 90/02; B65D 21/086; B65D 12/08; B65D 88/121; B65D 88/12; B65D 90/0006; B65D 88/005; B65D 90/023; B65D 90/06; B28B 13/00; E04B 1/34336; E04B 1/3442; E04B 1/34305; E04B 1/343; E04B 1/3431; E04H 1/12; E04H 9/16; E04G 11/36
USPC ..... 220/1.5, 8, 6, 668, 4.01, 660
See application file for complete search history.

(56) References Cited

U.S. PATENT DOCUMENTS 4,506,798 A 3/1985 Goutille
4,722,156 A 2/1988 Sato
(Continued)

FOREIGN PATENT DOCUMENTS

EP 0049599 4/1982
EP 2327345 6/2011
(Continued)

OTHER PUBLICATIONS

International Search Report for PCT/AU2013/000129, Completed by the Australian Patent Office on Apr. 15, 2013, 6 Pages.
(Continued)

*Primary Examiner* — Robert J Hicks
(74) *Attorney, Agent, or Firm* — Brooks Kushman P.C.

(57) ABSTRACT

A height adjustable column for a shipping container building structure. The height adjustable column has an upper sleeve portion, a middle sleeve portion and a lower sleeve. When the column is in the non-extended position the middle sleeve portion is fully slid within the lower and upper sleeve portions and a substantive length of the upper sleeve portion is slid within the lower sleeve portion such that ISO apertures in the middle sleeves are aligned whereby the height of the column is at a reduced height compared to that that of a standard shipping container. When the column is in the extended position locking means on the middle sleeve portion engage and lock with the corresponding slotted apertures on the lower and upper sleeve portions as to support and retain the column at a height equal to or greater than the height of a standard shipping container.

19 Claims, 16 Drawing Sheets

(51) Int. Cl.

| | |
|---|---|
| ***B65D 90/00*** | (2006.01) |
| ***E04B 1/343*** | (2006.01) |
| ***E04B 1/344*** | (2006.01) |
| ***E04G 11/36*** | (2006.01) |
| ***B65D 90/02*** | (2006.01) |
| ***B65D 88/12*** | (2006.01) |
| ***B65D 90/06*** | (2006.01) |
| ***E04H 9/16*** | (2006.01) |
| *E04B 1/348* | (2006.01) |
| *E04H 1/12* | (2006.01) |

(52) U.S. Cl.

CPC ..... *B65D 90/0026* (2013.01); *B65D 90/0033* (2013.01); *B65D 90/02* (2013.01); *B65D 90/023* (2013.01); *B65D 90/06* (2013.01); *E04B 1/3431* (2013.01); *E04B 1/3442* (2013.01); *E04B 1/34305* (2013.01); *E04B 1/34336* (2013.01); *E04G 11/36* (2013.01); *E04H 1/12* (2013.01); *E04H 9/16* (2013.01); *E04B 1/3483* (2013.01); *E04B 2001/34389* (2013.01); *E04B 2001/34876* (2013.01); *E04B 2001/34884* (2013.01); *E04H 2001/1283* (2013.01)

(56) References Cited

U.S. PATENT DOCUMENTS

| | | | | |
|---|---|---|---|---|
| 6,112,929 | A | 9/2000 | Ota | |
| 2011/0023925 | A1 | 2/2011 | Johnson et al. | |
| 2012/0006369 | A1 * | 1/2012 | Cantin ..... | E04B 1/34305 135/96 |

FOREIGN PATENT DOCUMENTS

| | | |
|---|---|---|
| GB | 1505866 | 3/1978 |
| GB | 2085507 | 4/1982 |
| GB | 2345282 | 7/2000 |
| GB | 2406560 | 4/2005 |

OTHER PUBLICATIONS

Written Opinion for PCT/AU2013/000129, Completed by the Australian Patent Office, Dated Apr. 15, 2013, 4 Pages.

Second Written Opinion for PCT/AU2013/000129, Completed by the Australian Patent Office, Dated Dec. 3, 2013, 6 Pages.

Third Written Opinion for PCT/AU2013/000129, Completed by the Australian Patent Office, Dated Feb. 19, 2014, 6 Pages.

* cited by examiner

HEIGHT ADJUSTABLE COLUMN FOR A SHIPPING CONTAINER BUILDING STRUCTURE

CROSS-REFERENCE TO RELATED APPLICATION

This application is the U.S. national phase of PCT Application No. PCT/AU2013/000129 filed on Feb. 15, 2013, which claims priority to AU Patent Application No. 2012900570 filed on Feb. 17, 2012, the disclosures of which are incorporated in their entirety by reference herein.

FIELD OF THE INVENTION

The invention relates to a Height Adjustable Column for a Shipping Container Building Structure

BACKGROUND OF INVENTION

A problem with existing methods of shipping standard shipping containers lies in the height and transport costs of a product which does not take up the full space within the container particularly where the container is to be used as some form of accommodation. In such cases the interior of the container is often almost empty but because the eventual residential height in the container is full height the transport costs are high.

Equally, where accommodation which is greater than the height of a shipping container must be provided the only real option is to provide it as two containers, one without floor, which must be mounted on top of each other. Having a shipping container that can be raised from a height for transportation to a height for use as a building structure is desired.

PRIOR REFERENCES

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications may be referred to herein; this reference does not constitute an admission that any of these documents form part of the common general knowledge in the art, in New Zealand or in any other country.

OBJECT OF THE INVENTION

It is an object of the invention to provide a height adjustable column for a shipping container building structure that ameliorates some of the disadvantages and limitations of the known art or at least provide the public with a useful choice.

SUMMARY OF INVENTION

In a first aspect the invention resides in a height adjustable column for a shipping container building structure, wherein the column has at least two co-operating parts, in which a first part of the column telescopes over a second part of the column, both parts having engagement features engageable by a container handling apparatus such that the column can be extended from a telescoped form to an extended position, wherein when in the telescoped form a substantive length of the second part is within the first part and when in the extended position a substantive length of the second part extends outwardly from the first part, the engagement feature of the first part when the column is in the extended position is adapted to engage and support a floor of a building structure and the engagement feature of the second part when the column is in the extended position is adapted to engage and support either the roof or an upper floor of a building structure, the column, when in telescoped form is adapted to secured to a base of a shipping container at one end and to an upper surface of the shipping container at the other end, such that when the column is in the non-extended position the height of the column is at a reduced height compared to that that of a standard shipping container and when in the extended position the column is at a height equal to or greater than the height of a standard shipping container.

In a second aspect the invention resides in a height adjustable column for a shipping container building structure, wherein the column has:

(i) upper sleeve portion, having an upper part with engagement features engageable by a container handling apparatus and a lower part with slotted apertures adapted to engage with locking means on a corresponding sleeve, (ii) middle sleeve portion, having an upper part with engagement features engageable by a container handling apparatus and with locking means and a lower part with engagement features engageable by a container handling apparatus and with locking detents, (iii) lower sleeve portion, having an upper part with slotted apertures adapted to engage with locking means on a corresponding sleeve and a lower part with engagement features engageable by a container handling apparatus, (iv) lifting points situated at the top part of the upper sleeve portion and the lower part of the lower sleeve portion, the lifting points accommodating the respective engagement features of the upper and lower sleeve portions, and (v) engagement means to engage and hold structural elements of a building structure in place when the column is an extended position, wherein the middle sleeve portion is adapted to slide and be positionable within relative to the lower and upper sleeve portions and the upper sleeve portion is adapted to slide and be positionable within relative to the lower sleeve portion so that when the column is in the non-extended position the middle sleeve portion is fully slid within the lower and upper sleeve portions and a substantive length of the upper sleeve portion is slid within the lower sleeve such that the lower engagement feature of the middle sleeve portion is aligned and coincides with the engagement feature of the lower sleeve portion and the upper engagement feature of the middle sleeve portion is aligned and coincides with the engagement feature of the upper sleeve portion such that the height of the column is at a reduced height compared to that that of a standard shipping container; when the column is in the extended position the locking means on the middle portion engage and lock with the corresponding slotted apertures on the lower and upper sleeve portions as to support and retain the column at a height equal to or greater than the height of a standard shipping container.

Preferably, the lower sleeve has a floor engaging portion adapted to engage and attach to a floor of a building structure.

Preferably, the upper sleeve has a roof or upper level engaging portion adapted to engage and attach to a roof or upper level of a building structure.

Preferably, the locking means are spring loaded detents.

Preferably, the engagement features are apertures adapted to receive and engage with the container handling apparatus in order to allow the column to be raised from a non extended state to an extended raised state.

Preferably, the apertures are of the ISO standard container connection points.

Preferably, the engagement means includes a slot, channel or groove capable of receiving and holding an edge or part of an edge of a wall panel, window frame or door frame therein.

Preferably, the engagement means includes projection means capable of receiving and holding an edge or part of an edge of a roof section, floor, window frame or door frame thereon.

Preferably, the engagement means includes a bracket or flange capable of receiving and holding an edge or part of an edge of a roof section, floor, wall panel, window frame or door frame thereon.

Preferably, in the expanded form the column remain capable of supporting vertical loads.

Preferably, the column is hollow.

Preferably, the interior space of the hollow column is capable of receiving pourable settable material therein once the column is in the extended position in order to provide a strong, rigid and durable column able to support and bear loads associated with a building structure.

Preferably, the column may include elements acting as reinforcement for the settable material.

Preferably, the reinforcement elements may extend through to a lower floor, roof or upper floor of a building structure.

In a third aspect the invention resides in a height adjustable column for a shipping container building structure, wherein the column has:

(i) at least an upper sleeve portion, having an upper part with engagement features engageable by a container handling apparatus and a lower part with slotted apertures adapted to engage with locking means on a corresponding sleeve, (ii) at least a lower sleeve portion, having an upper part with slotted apertures adapted to engage with locking means on a corresponding sleeve and a lower part with engagement features engageable by a container handling apparatus, and (iii) engagement means to engage and hold structural elements of a building structure in place when the column is an extended position, wherein the upper sleeve portion is adapted to slide and be positionable within relative to the lower portion so that when the column is in the non-extended position a substantive length of the upper sleeve portion is slid within the lower sleeve such that the height of the column is at a reduced height compared to that that of a standard shipping container; when the column is in the extended position the locking means on the each of the sleeve portions engage and lock with the corresponding slotted apertures on the sleeve portions so as to support and retain the column at a height equal to or greater than the height of a standard shipping container.

Preferably, the columns has additional sleeve portions adapted to slide and be positionable within relative to the lower and upper sleeve portions.

In fourth aspect as herein described the invention relates to a method of manufacturing an expandable shipping container utilising columns described in the aforementioned aspects, wherein the method includes:

(i) providing a container base and columns, the columns when not expanded extending to a packaged height, (ii) providing at least one first vertical wall portion attached to the base and extending less than the packaged height of the container, (iii) providing an upper surface secured at at least one position to an upper portion of an expandable vertical column, (iv) providing at least one second vertical wall portion extending towards the first vertical wall portion from the upper surface; and (v) extending the columns to an expanded position further spacing the first vertical wall portion from the second vertical wall portion.

BRIEF DESCRIPTION

The invention will now be described, by way of example only, by reference to the accompanying drawings.

DESCRIPTION OF THE PREFERRED EMBODIMENT(S)

The following description will describe the invention in relation to preferred embodiments of the invention, namely a height adjustable shipping container The invention is in no way limited to these preferred embodiments as they are purely to exemplify the invention only and that possible variations and modifications would be readily apparent without departing from the scope of the invention.

Figure 1:
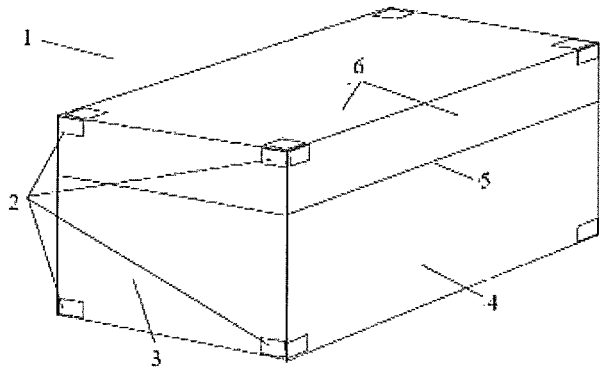
FIG. 1 is a height adjustable shipping container in accordance with an embodiment of the invention.

FIG. 1 shows a height adjustable shipping container 1 in which vertical corner rails extend to trucking and lifting points 2 at each end. Vertical walls on the exterior extend to cut line 5 forming partial end panel 3, partial side panel 4 and top panel and top side partial panels 6.

Figure 2:
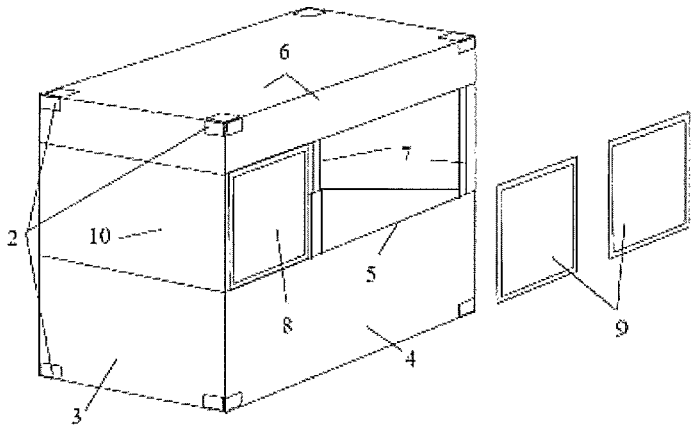
FIG. 2 is the container of FIG. 1 in an expanded position.

FIG. 2 shows the container of FIG. 1 in expanded form in which telescoping rails 7 have been expanded, a panel 10 formerly behind panel 3 has been pulled up into place and a window 8 formerly packed inside the container with windows 9 has been placed in the gap formed by expansion. Other panels or equipment which may have been packed within the container, such as doors, roller doors, ventilators, tables, etc can be fitted to the expanded container. Still others may be permanently fitted to the container before dispatch, such as lighting or plumbed fitments.

Figure 3:
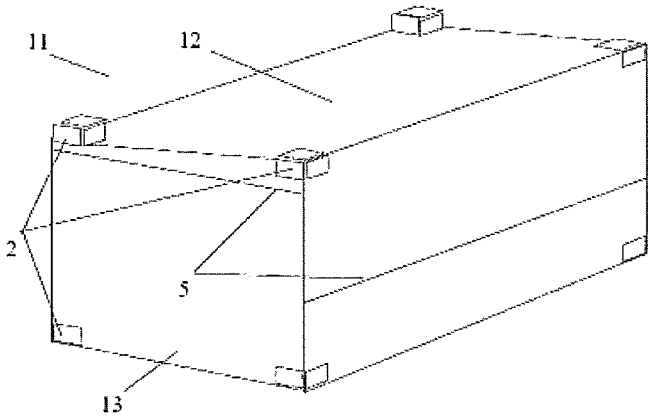
FIG. 3 is a variation of the container of FIG. 1.
Figure 4:
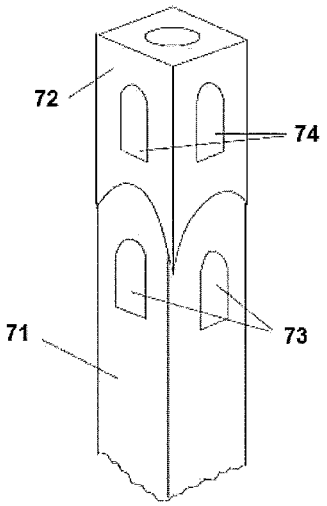
FIG. 4 is a detail of a telescoping expanding vertical container column in accordance with a first preferred embodiment of the invention.
Figure 5:
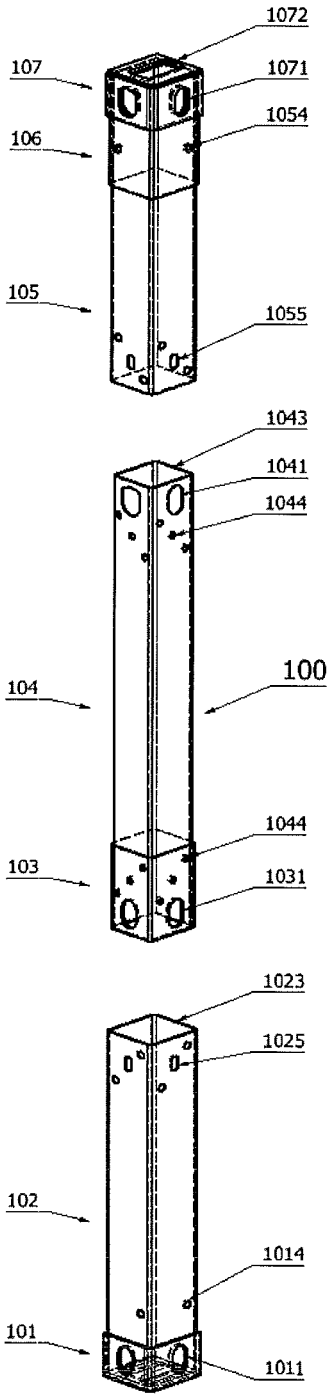
FIG. 5 is an exploded view of a column in accordance to the preferred embodiment of the invention.

FIG. 3 shows a container 11 with a tilted top forming part of a peaked pitched roof 12 and an end panel 13. Cut lines 5 are offset, providing for different panel fitments at each cut. Typically any services required in the container (plumbing, electrical) are located adjacent a joint line to allow easy servicing and testing on installation. FIG. 4 shows a view of a telescoping column in expanded form. A lower portion 71 with engagement feature 73 for trucking or lifting has a cap 72 which slides down over portion 71. When slid down the engagement features 74 align with those at 73 to allow lifting the compacted container.

It is important that the compacted container still adheres to the measurements of a standard shipping container which means that in some cases a collapsed telescoping pole will still stand above part of the structure of a containerised building, as in FIG. 3.

FIG. 4 shows a view of a telescoping pole in expanded form. A lower portion 71 with engagement feature 73 for trucking or lifting has a cap 72 which slides down over portion 71. When slid down the engagement features 74 align with those at 73 to allow lifting the compacted container.

Figure 6:
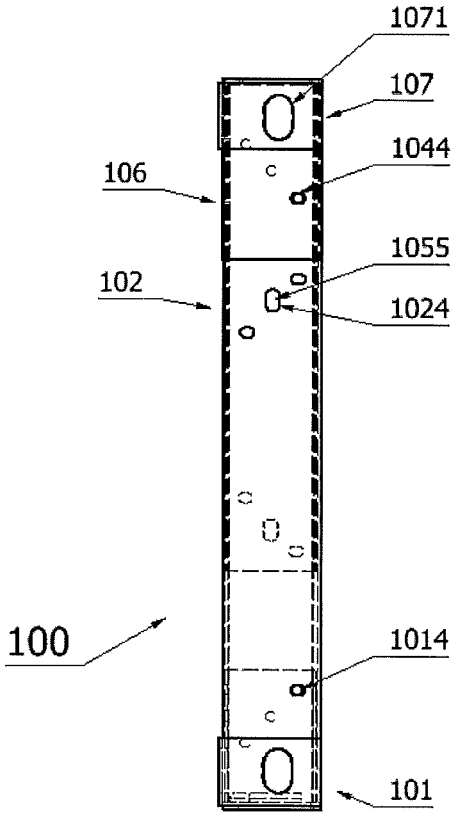
FIG. 6 is side view of the column as shown in FIG. 5 in a non-extended state.
Figure 7:
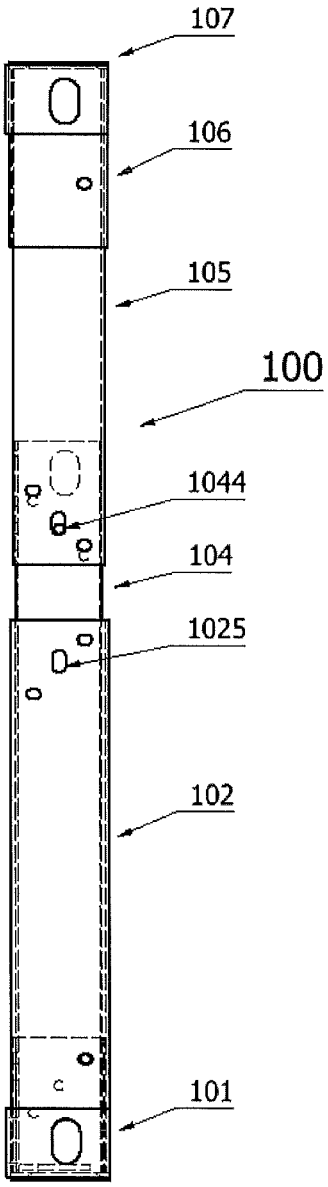
FIG. 7 is side view of the column as shown in FIG. 5 in a partially extended state.
Figure 8:
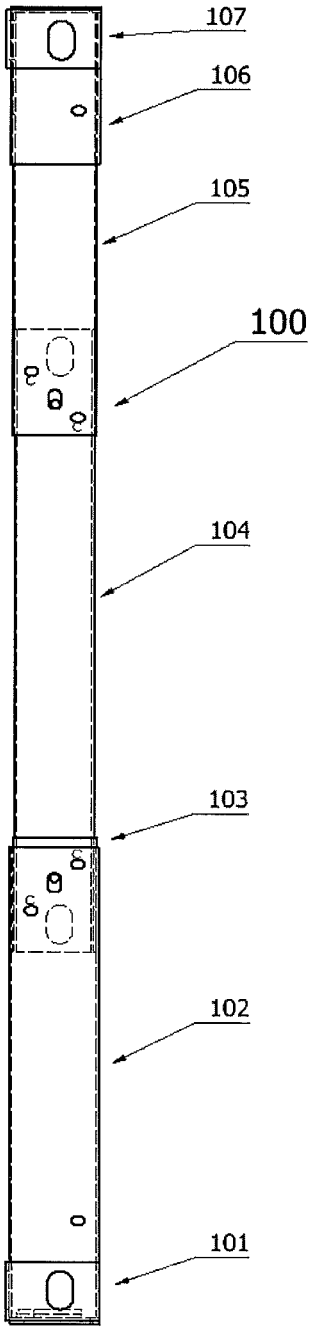
FIG. 8 is side view of the column as shown in FIG. 5 in a fully extended state.
Figure 9:
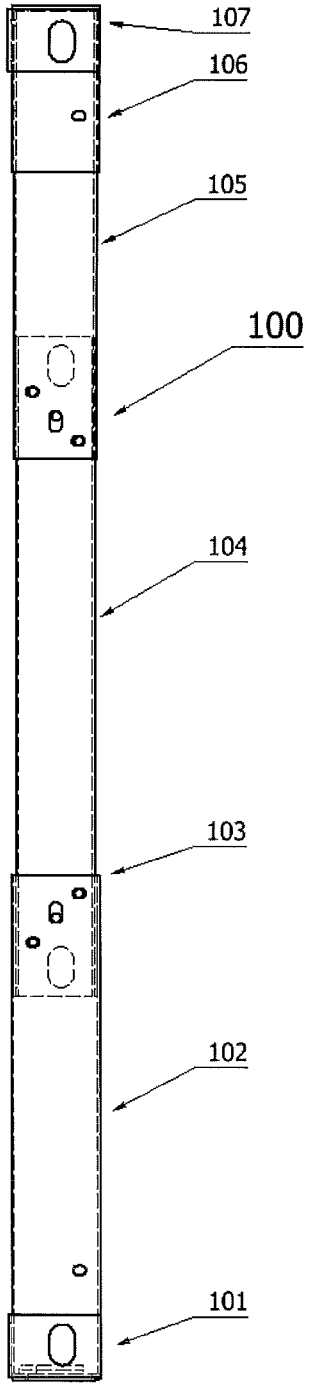
FIG. 9 is side view of the column as shown in FIG. 5 in a final extended state.

FIGS. 5 to 9 show views of a preferred form of the column. The column 100 includes three telescoping sleeves 102, 104, 105 in which sleeves 102, 104 telescopes within lower parts 101 such that when the column 100 is in the non-extended position the height of the column at a reduced height compared to that that of a standard shipping container and when in the extended position the column 100 is at a height equal to or greater than the height of a standard shipping container. The upper sleeve 105 has an upper part 107 with apertures 1071, 1072 engageable by a container handling apparatus such as fork lift truck in order to assist in the raising, lowering and adjusting the height of the column. The lower part of the upper sleeve 105 has slotted apertures 1055 that engage with locking detents 1044 on the middle sleeve 104. The middle sleeve also has apertures 1031, 1041 engageable by a container handling apparatus such as fork lift truck when the column is in its unextended state where the apertures are aligned and coincide with the respective apertures 1011, 1071 of the lower and upper sleeves 102,105. The lower sleeve 102 has a lower part 101 with apertures 1011 engageable by a container handling apparatus such as fork lift truck in order to assist in the raising, lowering and adjusting the height of the column. The upper part of the lower part 101 has slotted apertures 1025 that engage with respective locking detents 1044 on the middle sleeve 104. FIG. 6 shows a column 100 in non-extended state where the middle and upper sleeves 104, 105 are telescoped within the lower sleeve 102 such that the respective container handling apparatus apertures are aligned and coincide ready to accommodate container handling apparatus to move and raise a shipping container incorporating such columns. FIG. 7 shows a partially extended column 100. FIG. 8 shows a fully extended column 100 suitable to allow wall panels, windows and doors to be erected. FIG. 9 shows a column in its final height in which its lowered from the maximum height extension as shown in FIG. 8 in order to firmly hold and seal the wall panels, windows, doors in place.

Figure 10:
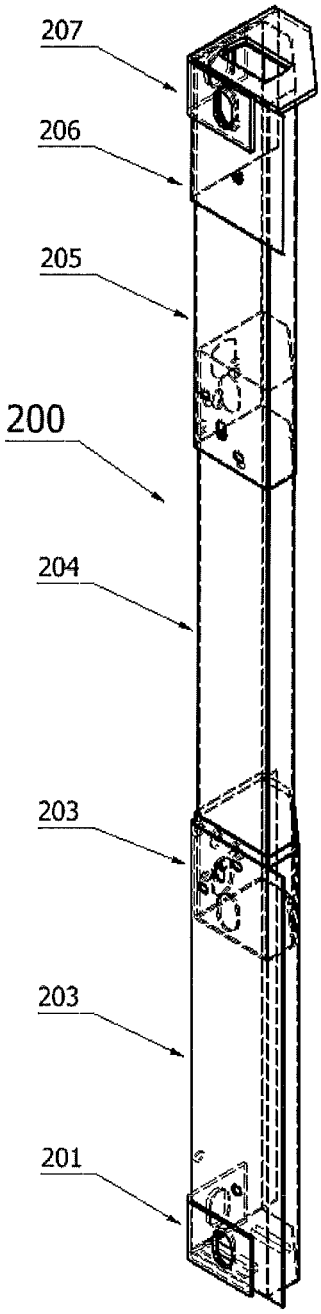
FIG. 10 is perspective view of a column in accordance to another embodiment of the invention.

FIG. 10 shows an alternative column 200 having a different cross-sectional profile to the columns as shown in FIGS. 5 to 9.

Figure 11:
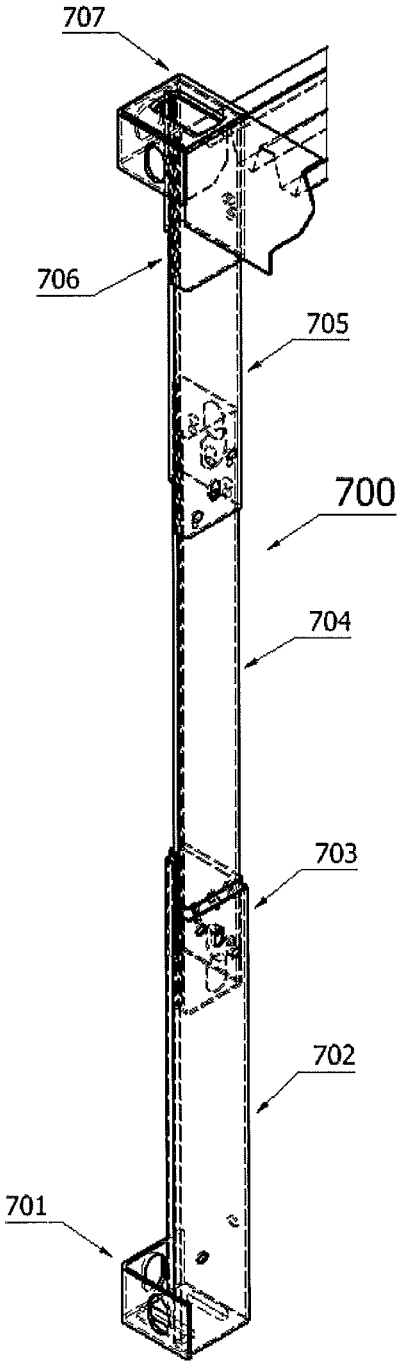
FIG. 11 is perspective view of a column in accordance to a further embodiment of the invention.
Figure 12:
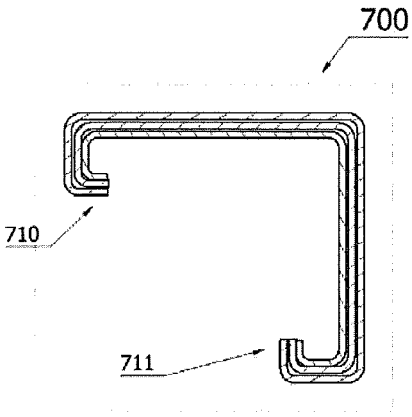
FIG. 12 is a cross-sectional profile of the columns shown in FIG. 11.
Figure 13:
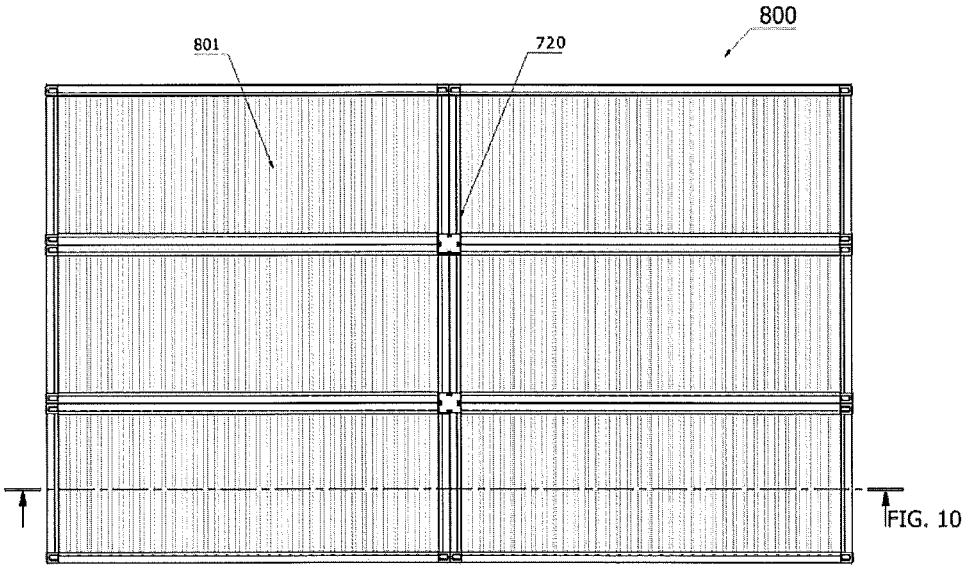
FIG. 13 is a view of a building structure incorporating the column as shown in FIG. 11.
Figure 14:
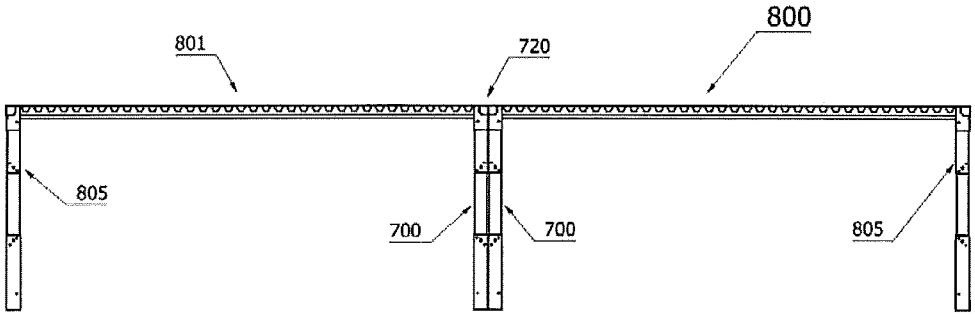
FIG. 14 is a side view of a building structure incorporating the column as shown in FIG. 11.
Figure 15:
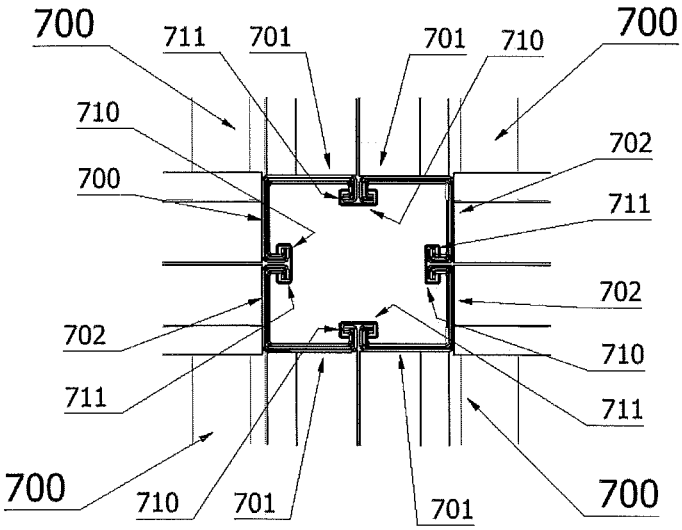
FIG. 15 is a top cut-away view of a building structure incorporating the column as shown in FIG. 11

FIGS. 11 & 12 show a column 700 suitable to be used where multiple shipping containers like structures are to be joined together as shown in FIG. 13. Instead of a square, rectangular or other closed polygonal cross-sectional profile, the column 700 has an open cross-sectional profile (FIG. 12) that allow for the column 700 to abut and co-operate with three adjacent columns (FIGS. 14, 15) so that columns 700 can be coupled together to provide structural rigidity and integrity to adjacent sections of the building structure.

Figure 16:
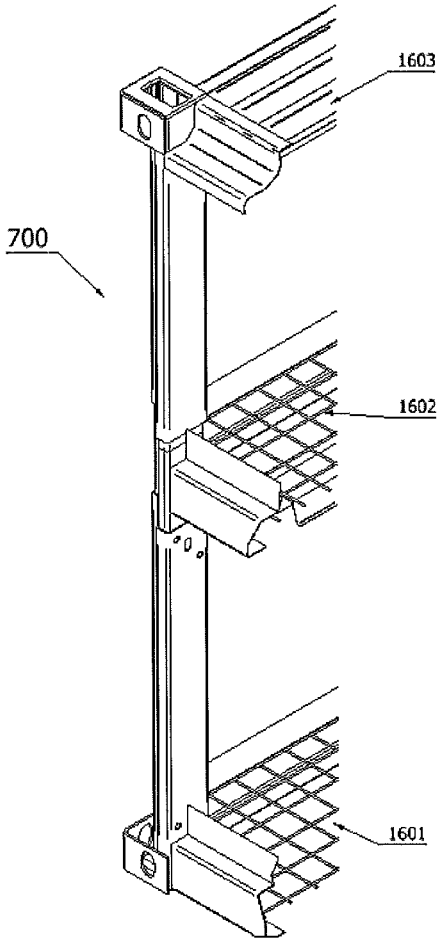
FIG. 16 is a perspective of the column an extended state in accordance to a further embodiment of the invention.
Figure 17:
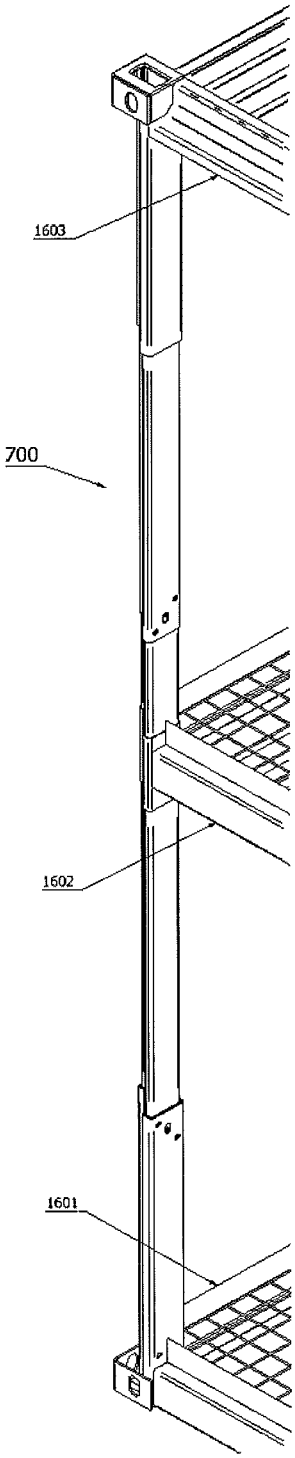
FIG. 17 is a perspective of the column as shown in FIG. 16 in an extended state.
Figure 18:
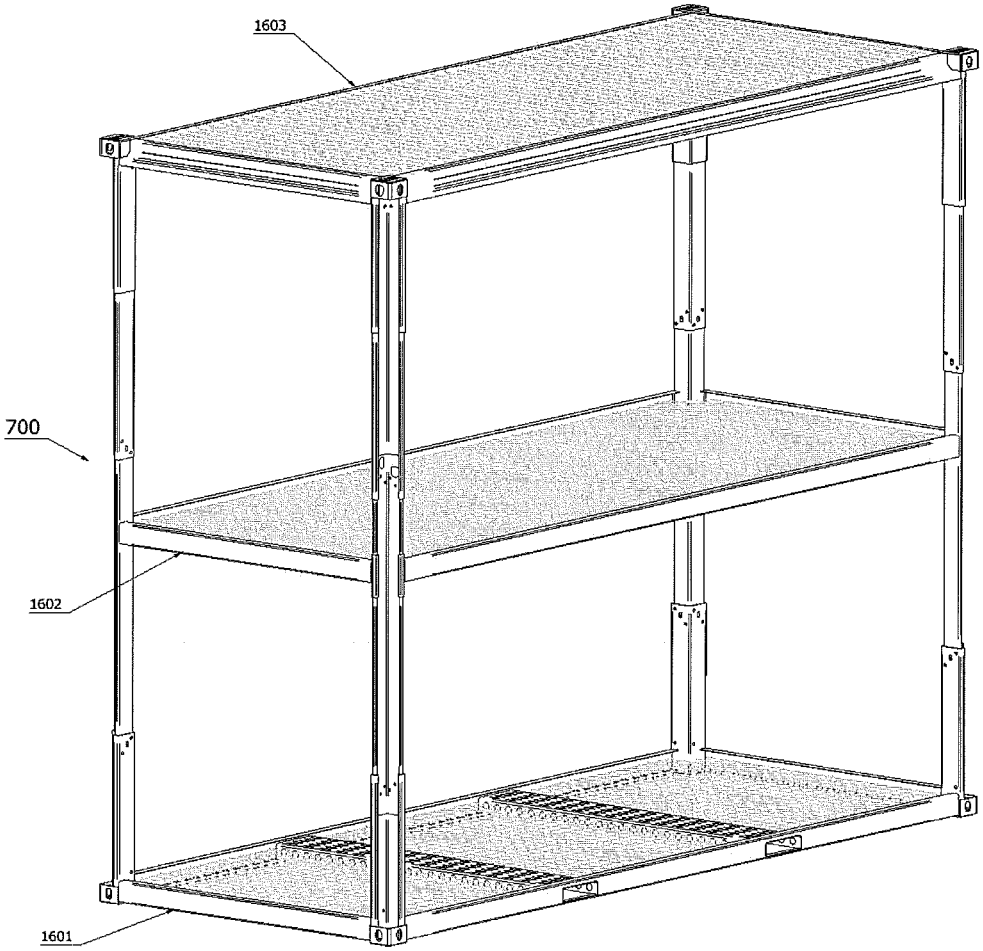
FIG. 18 is a view of a building structure incorporating the column as shown in FIG. 16
Figure 19:
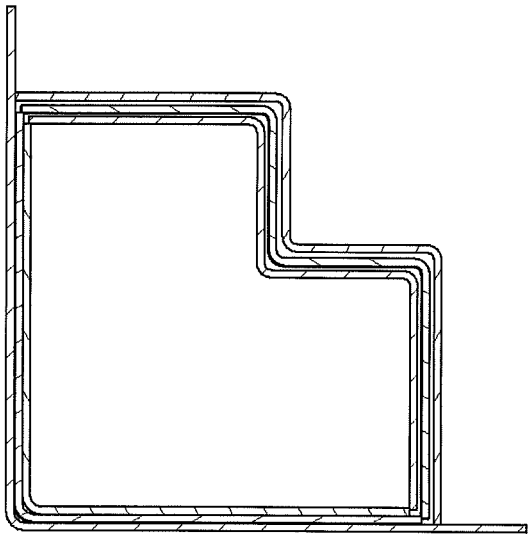
FIGS. 19 to 22 show differing preferred cross-sectional profile views of the column.

FIGS. 16 to 18 show another alternative column arrangement where the column 700 is able to be extended forms a storage & transportation height (FIG. 16) to a multi storey extended height (FIGS. 17 & 18). The column is able to support not just the floor and roof sections 1601, 1602 but also an upper floor 1602, thus allowing for a multi-storey building structure to be assembled from components transported in shipping container having such columns 700.

Figure 20:
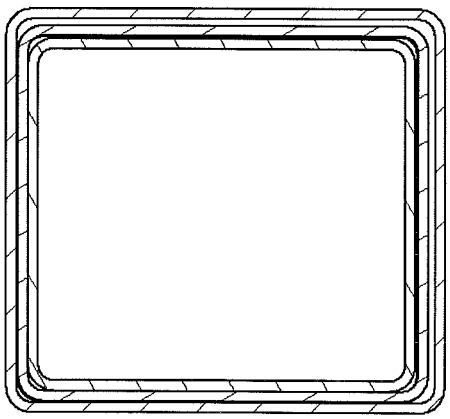
Figure 21:
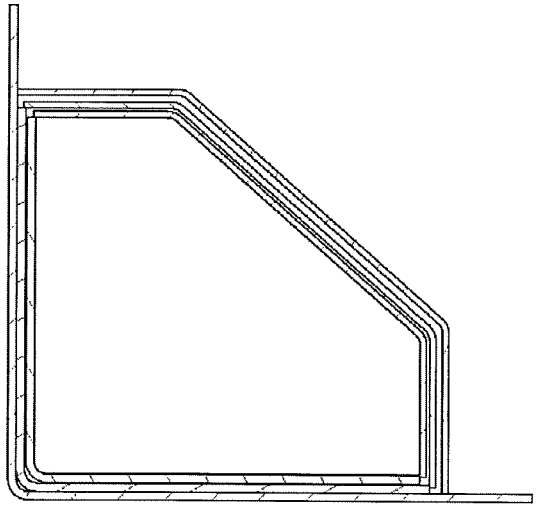
Figure 22:
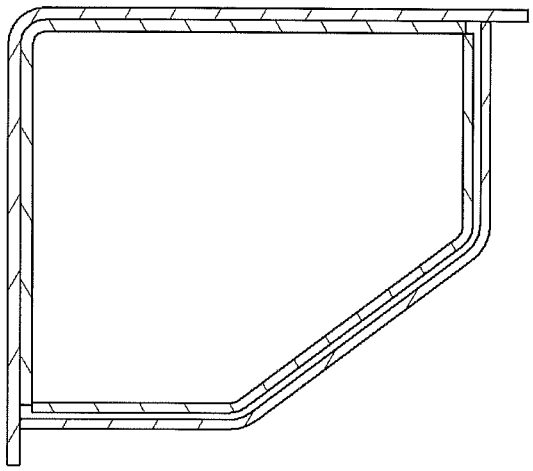

FIGS. 19 to 22 show differing column profiles that are preferred. The profile shown in FIG. 19 allows for two piece fabricated sections, exterior landing to secure wall panels, inside face aligns with wall panels and is very rigid. FIG. 20 is just a standard off the shelf square rolled profile that is suitable for most situations. The profile shown in FIG. 21 has fabricated sections and allows ducting services to get past column behind a coving. The profile shown in FIG. 22 is similar to that of that of FIG. 21 but is used for a two piece column.

The columns can include features to engage with and hold building elements, such as roof sections, floor, wall panels, window and door frames, etc in place once the columns are fully extended. These features, either separately or in combination. can include slots, channels, grooves, projections, flange, brackets, etc where these features are capable of receiving and holding an edge or part of an edge of a, roof section, floor wall panel, window frame or door frame therein or thereon.

In the expanded form the column remains capable of supporting vertical loads.

Preferably, the column is hollow.

The interior space of the hollow column is capable of receiving therein pourable settable material such as concrete once the column is in the extended position in order to provide a strong, rigid and durable column able to support and bear loads associated with a building structure. The column may also include elements acting as reinforcement for the settable material. The reinforcement elements may extend through to a lower floor, roof or upper floor of a building structure.

It is possible to gain as much height as possible from the columns for the purpose of a minimum habitable ceiling height of 2400 mm or even higher in some situations. The maximum available column height is very important because of the space and height required for the ceiling and roof area height combined with the floor sections that may also require the installation of services. By eliminating the ISO castings that exist on standard containers at present where the height of these castings is approximately 120 mm each. by combining the top and bottom ISO castings there was 240 mm additional available height and utilizing this height with the inventive column that could be overlapped at least twice if not 3 or more times. An additional minimum of 480 mm of column height is able to be obtained that can be used for extending, overlaps, etc.

An important advantage with using the inventive columns is the ability to use both the standard height and the high cube containers as the basis of the height adjustable container and two or more near completed accommodation containers could be transported at the same time.

The column is preferably made from steel and has the holes therein can be laser cut.

The column can also be incorporated into a two, three or more stage column.

DRAWINGS NUMBER DESCRIPTION LIST

1 Container
2 Lifting Points
3 Partial End Panel
4 Partial Side Panel
5 Cut Line
6 Partial Top Side Panels
7 Telescoping Rails
8 Window
9 Window
10 Panel
11 Container
12 Roof
13 End Panel
71 Lower Portion
72 Cap
73 Engagement Feature
74 Engagement Feature
100 Column
101 ISO Standard Container Lower Corner Connection Point
102 Lower Section Inner Sleeve
103 Sliding Section Spacer Sleeve
104 Sliding Section Centre Sleeve
105 Upper Section Inner Sleeve
106 Upper Section Outer Sleeve
107 ISO Standard Container Upper Corner Connection Point
200 Column
201 ISO Standard Container Lower Corner Connection Point
202 Lower Section Inner Sleeve
203 Sliding Section Spacer Sleeve
204 Sliding Section Centre Sleeve
205 Upper Section Inner Sleeve
206 Upper Section Outer Sleeve
207 ISO Standard Container Upper Corner Connection Point
700 Column
701 ISO Standard Container Lower Corner Connection Point
702 Lower Section Inner Sleeve
703 Sliding Section Spacer Sleeve
704 Sliding Section Centre Sleeve
705 Upper Section Inner Sleeve
706 Upper Section Outer Sleeve
707 ISO Standard Container Upper Corner Connection Point
710 Flange
711 Flange
720 Central Columns
800 Building structure
801 Floor
805 Column
1014 Hole for Transport Locking Bolt, One Each Side
1023 Lower Sleeve Section, Could Be Made From Pressed Plate or RHS
1025 Slotted Hole for Positioning Detent
1031 ISO Corner Connection Point—Aligns With Lower Hole When In 'Down' Position
1041 Hole for Positioning Detent To Be Mounted In.
1043 Centre Sleeve Section, Could Be Made From Pressed Plate or RHS
1044 Locking Bolt Holes When In 'Up' Position
1054 Hole for Transport Locking Bolt, One Each Side
1055 Slotted Hole for Positioning Detent
1071 Side Plate with ISO Standard Connection Holes
1072 Top Plate with ISO Standard Connection Hole
1601 Floor
1602 Upper level
1603 Roof

ADVANTAGES a) Reduces welds and increases strength.
b) Reduced cost
c) Eliminates ISO corner castings
d) Single manufacturing system for production of columns
e) Allows for additional height to be gained
f) Allows the column sections to be locked together when they are lifted as two or more sleeves of steel column will be captured or engaged by the lifting apparatus locking keys/lugs.
g) Allows the full use of the area of the container
h) Up to eight column types
i) Shaped to mimic ISO block
j) Staged columns with 2, 3 or more sliding and telescoping sleeve portions
k) Interlocking for extra height
l) Hollow and able to be filled with concrete
m) Include the lifting points

VARIATIONS

It will of course be realised that while the foregoing has been given by way of illustrative example of this invention, all such and other modifications and variations thereto as would be apparent to persons skilled in the art are deemed to fall within the broad scope and ambit of this invention as is hereinbefore described.

The invention claimed is:

1. A height adjustable column for a shipping container building structure, wherein the column has:

(i) an upper sleeve portion, having an upper part with engagement features engageable by a container handling apparatus and a lower part with slotted apertures adapted to engage with locking means on a corresponding sleeve, and wherein the upper sleeve portion has an open cross section;

(ii) a middle sleeve portion, having an upper part with engagement features engageable by a container handling apparatus and with locking means and a lower part with engagement features engageable by a container handling apparatus and with locking detents, and wherein the middle sleeve portion has an open cross section;

(iii) a lower sleeve portion, having an upper part with slotted apertures adapted to engage with locking means on a corresponding sleeve and a lower part with engagement features engageable by a container handling apparatus, and wherein the lower sleeve portion has an open cross section;

(iv) lifting points situated at the upper part of the upper sleeve portion and/or the lower part of the lower sleeve portion, the lifting points accommodating the respective engagement features of the upper and lower sleeve portions for lifting purposes and the lifting points having removable means with co-operating engagement features that are alignable with the respective engagement features of the upper and lower sleeve portions, the removable means are adaptable to be removed to allow access to and use of an interior of the column once the column is at the adjusted height within the building structure, and engagement means to engage and hold structural elements of a building structure in place when the column is in an extended position, wherein the middle sleeve portion is adapted to slide and be positionable within the lower and upper sleeve portions and the upper sleeve portion is adapted to slide and be positionable within the lower sleeve portion so that when the column is in a non-extended position the middle sleeve portion is fully slid within the lower and upper sleeve portions and a substantive length of the upper sleeve portion is slid within the lower sleeve such that the lower engagement feature of the middle sleeve portion is aligned and coincides with the engagement feature of the lower sleeve portion and the upper engagement feature of the middle sleeve portion is aligned and coincides with the engagement feature of the upper sleeve portion such that the height of the column is at a reduced height when the column is in the extended position the locking means on the middle portion engage and lock with the corresponding slotted apertures on the lower and upper sleeve portions as to support and retain the column in an extended position.

2. A height adjustable column according to claim 1 wherein a first part of the sleeve portions have substantially 'L'-shaped cross-section.

3. A height adjustable column according to claim 2 wherein a second part of the sleeve portions have a substantially 'L'-shaped cross section.

4. The height adjustable column as claimed in claim 3, wherein the locking means are spring loaded detents.

5. The height adjustable column as claimed in claim 4, wherein the engagement features are apertures adapted to receive and engage with the container handling apparatus in order to allow the column to be raised from a non-extended state to an extended raised state.

6. The height adjustable column as claimed in claim 4, wherein the engagement means includes a slot, channel or groove capable of receiving and holding an edge or part of an edge of a wall panel, window frame or door frame therein.

7. The height adjustable column as claimed in claim 4, wherein the engagement means includes projection means capable of receiving and holding an edge or part of an edge of a roof section, floor, window frame or door frame thereon.

8. The height adjustable column as claimed in claim 4, wherein the engagement means includes a bracket or flange capable of receiving and holding an edge or part of an edge of a roof section, floor, wall panel, window frame or door frame thereon.

9. The height adjustable column as claimed in claim 8, wherein, in the extended position the column remains capable of supporting vertical loads.

10. The height adjustable column as claimed in claim 1, wherein, the column is hollow.

11. The height adjustable column as claimed claim 10, wherein the interior space of the hollow column is capable of receiving pourable settable material therein once the column is in the extended position in order to provide a strong, rigid and durable column able to support and bear loads associated with a building structure.

12. The height adjustable column as claimed in claim 11, wherein the column may include elements acting as reinforcement for a settable material.

13. The height adjustable column as claimed in claim 12, wherein the reinforcement elements may extend through to a lower floor, roof or upper floor of a building structure.

14. A height adjustable column for a shipping container building structure, wherein the column has:

at least an upper sleeve portion, having an upper part with engagement features engageable by a container handling apparatus and a lower part with slotted apertures adapted to engage with locking means on a corresponding sleeve, the upper sleeve portion having an open cross section;

at least a lower sleeve portion, having an upper part with slotted apertures adapted to engage with locking means on a corresponding sleeve and a lower part with engagement features engageable by a container handling apparatus, the lower sleeve portion having an open cross section;

lifting points situated at the upper part of the upper sleeve portion and/or the lower part of the lower sleeve portion, the lifting points accommodating the respective engagement features of the upper and lower sleeve portions, for lifting purposes and the lifting points having removable means with co-operating engagement features that are alignable with the respective engagement features of the upper and lower sleeve portions, the removable means are adapted to be removed to allow access to and use of an interior of the column once the column is at the adjusted height within the building structure, and engagement means to engage and hold structural elements of a building structure in place when the column is an extended position, wherein the upper sleeve portion is adapted to slide and be positionable within to the lower portion so that when the column is in the non-extended position a substantive length of the upper sleeve portion is slid within the lower sleeve such the height of the column is at a reduced height when the column is in the extended position the locking means on the each of the sleeve portions engage and lock with the corresponding slotted apertures on the sleeve portions so as to support and retain the column in an extended position.

15. The height adjustable column as claimed in claim 14, wherein, the column has additional sleeve portions adapted to slide and be positionable within the lower and upper sleeve portions.

16. A height adjustable column for a shipping container building structure, wherein the column has:

an upper sleeve portion, having an upper part with engagement features engageable by a container handling apparatus and a lower part with slotted apertures adapted to engage with locking means on a corresponding sleeve, and wherein the upper sleeve portion has an open cross section;

a middle sleeve portion, having an upper part with engagement features engageable by a container handling apparatus and with locking means and a lower part with engagement features engageable by a container handling apparatus and with locking detents, and wherein the middle sleeve portion has an open cross section;

a lower sleeve portion, having an upper part with slotted apertures adapted to engage with locking means on a corresponding sleeve and a lower part with engagement features engageable by a container handling apparatus, and wherein the lower sleeve portion has an open cross section;

lifting points situated at the upper part of the upper sleeve portion and/or the lower part of the lower sleeve portion, the lifting points accommodating the respective engagement features of the upper and lower sleeve portions for lifting purposes and the lifting points having removable parts adapted to allow access to and use of an interior of the column once the column is at the adjusted height within the building structure, and engagement means to engage and hold structural elements of a building structure in place when the column is an extended position, wherein the middle sleeve portion is adapted to slide and be positionable within the lower and upper sleeve portions and the upper sleeve portion is adapted to slide and be positionable within the lower sleeve portion so that when the column is in a non-extended position the middle sleeve portion is fully slid within the lower and upper sleeve portions and a substantive length of the upper sleeve portion is slid within the lower sleeve such that the lower engagement feature of the middle sleeve portion is aligned and coincides with the engagement feature of the lower sleeve portion and the upper engagement feature of the middle sleeve portion is aligned and coincides with the engagement feature of the upper sleeve portion such that the height of the column is at a reduced height when the column is in the extended position the locking means on the middle portion engage and lock with the corresponding slotted apertures on the lower and upper sleeve portions as to support and retain the column in an extended position.

17. A height adjustable column for a shipping container building structure, wherein the column has:

at least an upper sleeve portion, having an upper part with engagement features engageable by a container handling apparatus and a lower part with slotted apertures adapted to engage with locking means on a corresponding sleeve, the upper sleeve portion having an open cross section;

at least a lower sleeve portion, having an upper part with slotted apertures adapted to engage with locking means on a corresponding sleeve and a lower part with engagement features engageable by a container handling apparatus, the lower sleeve portion having an open cross section;

lifting points situated at the upper part of the upper sleeve portion and/or the lower part of the lower sleeve portion, the lifting points accommodating the respective engagement features of the upper and lower sleeve portions for lifting purposes and the lifting points having removable parts adapted to allow access to and use of an interior of the column once the column is at the adjusted height within the building structure, and engagement means to engage and hold structural elements of a building structure in place when the column is an extended position, wherein the upper sleeve portion is adapted to slide and be positionable within the lower portion so that when the column is in the non-extended position a substantive length of the upper sleeve portion is slid within the lower sleeve such that the height of the column is at a reduced height; when the column is in the extended position the locking means on each of the sleeve portions engage and lock with the corresponding slotted apertures on the sleeve portions so as to support and retain the column at a maximum height.

18. The height adjustable column as claimed in claim 4, wherein the lower sleeve has a floor engaging portion adapted to engage and attach to a floor of a building structure.

19. A method of manufacturing an expandable shipping container utilizing columns, wherein the method includes:

(i) providing a container base and expandable vertical columns, the columns having lifting points situated at the upper part of an upper sleeve portion and/or the lower part of a lower sleeve portion, the lifting points accommodating the respective engagement features of the upper and lower sleeve portions for lifting purposes and the lifting points having removable means with co-operating engagement features that are alignable with respective engagement features of the upper and lower sleeve portions, the removable means being adaptable to be removed to allow access to and use of an interior of the column once the column is at the adjusted height, the columns when not expanded extending to a packaged height, (ii) providing at least one first vertical wall portion attached to the base and extending less than the packaged height of the container, (iii) providing an upper surface secured at at least one position to an upper portion of an expandable vertical column, (iv) providing at least one second vertical wall portion extending towards the first vertical wall portion from the upper surface; and (v) extending the vertical columns to an expanded position further spacing the first vertical wall portion from the second vertical wall portion and the upper surface from the base.

* * * * *